US005368270A

United States Patent [19]

Wiwczar

[11] Patent Number: 5,368,270

[45] Date of Patent: Nov. 29, 1994

[54] SPEAKER SUSPENSION DEVICE

[76] Inventor: Timothy V. Wiwczar, P.O. Box 373, Wading River, N.Y. 11792

[21] Appl. No.: 805,968

[22] Filed: Dec. 12, 1991

[51] Int. Cl.[5] ..... A47F 5/00

[52] U.S. Cl. ..... 248/610; 248/317; 248/316.4

[58] Field of Search ..... 248/317, 610, 316.4, 248/316.6, 316.1, 917, 919-924, 638, 581, 589, 327, 611; 381/188; 211/113

[56] References Cited

U.S. PATENT DOCUMENTS

| | | | |
|---|---|---|---|
| 809,356 | 1/1906 | Brown | 248/610 X |
| 2,268,495 | 12/1941 | Petty | 248/610 X |
| 2,402,682 | 6/1946 | Shriro et al. | 248/505 |
| 3,662,981 | 5/1972 | Hogrebe | 248/921 X |
| 3,911,221 | 10/1975 | Wong | 381/188 |
| 4,964,606 | 10/1990 | Beam et al. | 248/919 X |
| 5,179,367 | 1/1993 | Shimizu | 248/317 X |

*Primary Examiner*—Karen J. Chotkowski
*Attorney, Agent, or Firm*—Kelly & Hulme

[57] ABSTRACT

A stable, directable suspending device for elevating a speaker is provided which device is comprised of a clamp portion for firmly holding said speaker and a suspending portion for attaching the clamped speaker to a ceiling or other support member. The direction in which the sound from the speaker is emitted is determined by the plane of the speaker around which the clamping portion is fixed with any internally or externally developed vibration being dampened by means provided as part of the support portion.

1 Claim, 1 Drawing Sheet

SPEAKER SUSPENSION DEVICE

BACKGROUND OF INVENTION

1. Field of the Invention

This invention relates to a device for suspending a sound producing speaker and more particularly to a device for stably and directably suspending a sound speaker.

2. Prior Art

It has often been found to be desirable to suspend a sound producing speaker, such as is typically used in combination with a record player, radio or other high fidelity installation in a home setting, in an elevated and directed orientation. This arrangement is desirable not only from a practical point of view (e.g.; restricted space available for locating the speaker) but also from a "quality of sound" perspective since many of today's speakers produce better sounds when elevated above the floor in a fixed relationship with the surrounding walls.

The mounting systems known in the art, however, do not always provide stable, directable support for the speaker and in some instances, the speaker enclosure itself is damaged or marred by the use of a particular suspending device. In addition, speakers which are floor mounted or otherwise provided with a fixed support (i.e.; shelves, stands and the like) produce certain vibrations, such as bass tones, which may be undesirably transferred to the support structure or any items that may be placed on the speaker. These vibrations may have a detrimental effect on the support structure or (more likely) on items placed on or in close proximity to the speaker. In addition, these vibrations have been found under certain circumstances to materially reduce the sound quality of the sound reproduced by the speaker.

It is therefore an object of the present invention to provide a speaker suspending device that may be used to elevate a speaker.

It is another object of the present invention to provide a device which may suspend said speaker in a stable, directable manner. stable, directable suspending device.

It is yet another object of the present invention to provide a device, the use of which does not damage or otherwise mar the speaker or speaker enclosure so mounted.

These and other object of the present invention will be apparent to those skilled in the art from the following specifications and claims together with the accompanying drawings.

SUMMARY OF THE INVENTION

A speaker suspending device which reduces or eliminates some of the problems of the prior art is accomplished by providing a speaker clamp that which is disposed around said speaker in a plane parallel to the plane of the sound output side of the speaker and means for suspending said clamp from a ceiling or other suitable high support which permits the speaker to be elevated at a suitable optimum sterophonic height above the floor with a reduction of said speaker's vulnerability to damage that might otherwise be inflicted on a floor mounted speaker (e.g.; by children, pets, through its use as an end table and the like).

In addition to elevating the speaker, the device of the present invention may provide for directability of the sound emitted from the speaker. This is accomplished by moving the device of the present invention backward or forward of the vertical central plane of said speaker which is parallel to said sound emitting surface of said speaker which will result in said sound emitting surface being directed downward or upward, respectively. The angle of the upward or downward direction is determined by the spacing between the actual clamp location and said central plane.

DETAILED DESCRIPTION OF THE PRESENT INVENTION

Figure 1:
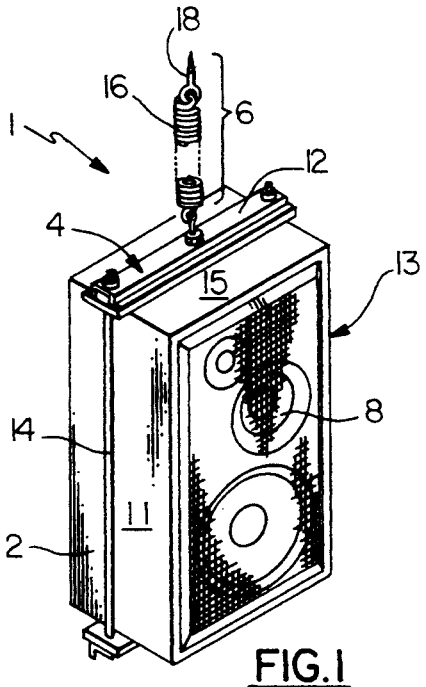
FIG. 1 is a perspective view of a speaker supported by the suspending device in accordance with the present invention.
Figure 2:
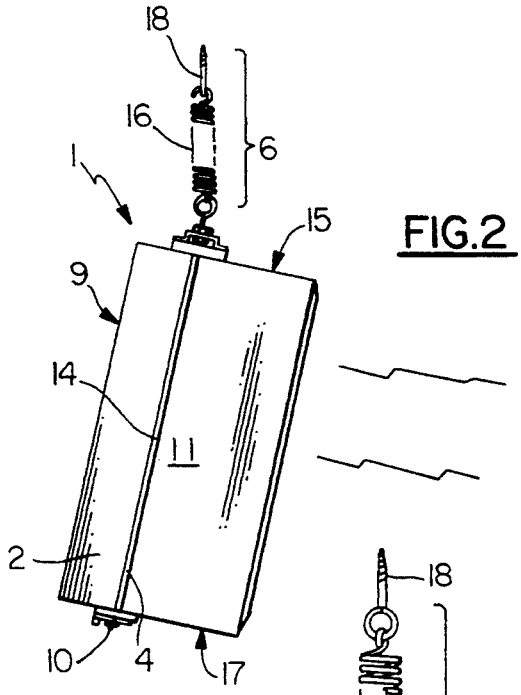
FIG. 2 is a side view of a speaker supported by the suspending device in accordance with the present invention showing the speaker directability feature thereof.
Figure 3:
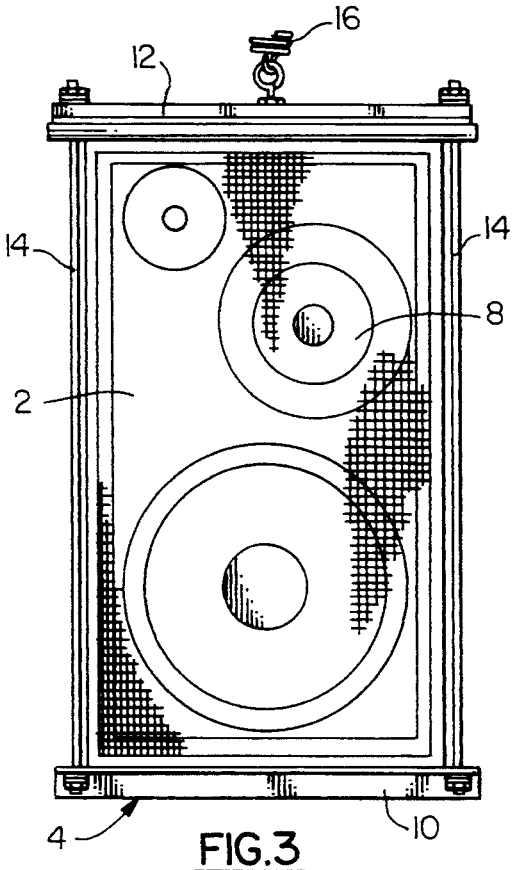
FIG. 3 is a front view of a speaker supported by the suspending device of the present invention.

In accordance with the present invention, and as shown in the drawings, there is described a speaker enclosure 2 operationally elevated by the suspending device 1 of the present invention. The components disposed within and the construction of said speaker are well known in the art and will therefore not be described here, but as depicted in the drawings, speaker 2 is comprised of a housing which is generally rectangular and has a front sound emitting surface 8, a rear back surface 9, a pair of spaced side walls 11 and 13, and top and bottom surfaces 15 and 17. The front sound emitting surface 8 is generally fitted with one or more sound reproducing devices (i.e.; speakers) mounted therein.

The suspending device 1 is comprised of a clamp portion 4 and a support portion 6. The clamp portion 4 is fixedly positioned around the speaker 2 along a plane parallel to the sound emiting surface 8 of the speaker 2 such that speaker 2 will not slip out of the suspension device 1 of the present invention while not causing damage to the speaker 2.

The suspending portion 6 of the device 1 of the present invention is joined, as depicted in the drawings, to one end of the clamp portion 4 such that the device 1 may be suspended from a ceiling or other suitable support structure thus elevating the speaker above the floor.

As can be seen in the drawings the clamp portion 4 of suspending device 1 includes an elongated lower member 10 which is dispersed horizontally along the bottom of said speaker 2. A similar elongated upper member 12 is positioned in an overlapping vertically spaced relationship to base member 10 over the top of said speaker 2.

The lower and upper members, 10 and 12, are maintained in said overlapping vertically spaced relationship around said speaker 2 by a plurality of vertical rods 14 which extend between and join together the two vertically spaced members 10 and 12 such that said clamp portion 4 firmly grips the speaker 2.

As discussed above, the suspending device 1 includes a support portion 6, which is used to join clamp portion 4 to the structure (not shown) from which the device 1 is to be suspended. The support portion 6 is comprised of vibration dampening means 16, one end of which is joined to the upper member 12; and means 18 for joining the other end of said dampening means to the support structure.

The dampening means 16 most advantageously employed in the present invention is a heavy duty spring which will dampen any vibration produced by the speaker and prevent same from being transferred to the support structure. The dampening means 16 will also isolate the speaker from any vibrations produced elsewhere in the structure in which the speaker, suspension system and support structure are located.

The speaker suspending device 1 of the present invention may be attached to any suitable means for support of same such as a ceiling or stand. However, in selecting the support means, the size and weight of the speaker should be taken into account. In addition, when suspending the device from a ceiling, it is recommended that a ceiling joist or rafter be located to attach the present device to.

Figure 4:
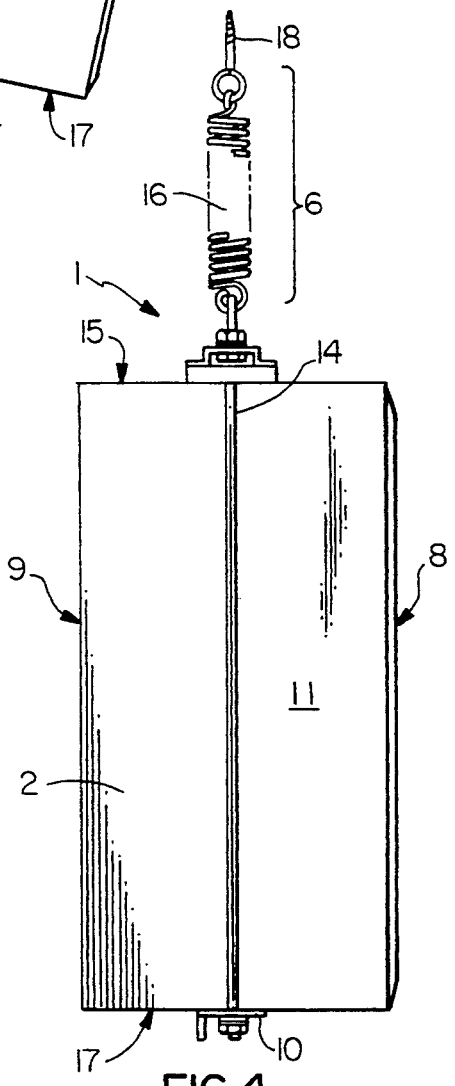
FIG. 4 is a side view of a speaker supported by the suspending device of the present invention.

As depicted in FIGS. 1 and 4 of the drawings, when clamp portion 4 is fixed around the central vertical plane parallel to sound emitting surface 8 (i.e.; at the halfway point between the sound emitting surface 8 and the opposing back surface 9 of said speaker 2), the sound emitting surface 8 will be positioned substantially perpendicular to the surface above from which it is suspended. However, when said clamp portion 4 is fixed around said speaker 2 closer to the surface 9 thereof, the sound emitting surface is directed downward. It will be clear to one skilled in the art that the opposite effect is achieved (i.e.; upward direction) if the clamp portion 4 is fixed around said speaker 2 forward of said central vertical speaker plane. In this manner, through trial and error, the user can direct the sound emitting from said speaker 2 in a desired direction.

As also described above, said clamp portion 4 is held together around said speaker by a plurality of rods 14. In a preferred embodiment of the present invention, these rods are threaded over their entire length such that they may receive a nut at both ends thereof so that said clamp portion 4 may be tightened around speaker 2. In addition, this arrangement allows the same speaker suspension device to be used on a variety of speaker sizes since the space intermediate of said upper and lower elongated members, 10 and 12, may be adjusted by the degree to which said nuts are threaded onto said rods 14.

Although the present invention has been depicted in combination with a rectangular speaker, it will be clear to one skilled in the art that the device of the present invention may be advantageously employed with speakers having other shapes. The first and second opposing elongated members, 10 and 12, need not be flat and for example may be curved to accommodate a speaker having a circular cross-section. In addition, speaker shapes that include at least two oppositely disposed parallel surfaces may be suspended using the device of the present invention.

While there has been shown and described above a particular arrangement of a speaker suspending device for the purpose of enabling a person skilled in the art to make and use the invention, it will be appreciated that the invention is not limited thereto. Accordingly, any modification, variation or equivalent arrangement within the scope of the attached claims should be considered within the scope of the invention.

What is claimed is:

1. A sound speaker suspending device for suspending and supporting a speaker; which speaker has a sound emitting surface, a back surface substantially parallel to said sound emitting surface, two opposite side surfaces and a top and a bottom surface; from a support structure in an elevated, stable and directable orientation comprising:

a clamping portion disposed around the sides, top and bottom of the speaker which firmly holds said speaker, the location of said clamping portion around said speaker determining the direction in which the sound emitting surface is disposed comprising (a) an elongated lower member disposed along the bottom surface of said speaker; (b) an elongated upper member positioned in an overlapping vertically spaced relation to said base member, with said speaker positioned intermediate to said bottom and upper members; and (c) a plurality of rods joining said upper and lower members together such that they clamp around and firmly hold said speaker; wherein said clamping portion may be positioned around the speaker adjacent to said sound emiting surface; adjacent to the back surface; and at any intermediate position therebetween such that the directional angle of the speaker may be changed as a result of the position selected for the location of the clamp, which clamp may furthermore be so clamped without marring or damaging the speaker surface and without the need to affix the clamp to the speaker; and a support portion having a first end joined to said clamping portion and a second end thereof removably joined to said support structure, comprising (a) means for dampening any externally or internally produced vibrations having a first end joined to said clamp portion; and (b) means for attaching a second end of said dampening means to said support structure.

* * * * *